United States Patent [19]

McKee et al.

[11] Patent Number: 4,577,908

[45] Date of Patent: Mar. 25, 1986

[54] METHOD FOR IN SITU SHALE OIL RECOVERY

[75] Inventors: Joseph M. McKee, Bartlesville, Okla.; Robert L. Horton, South Russell, Ohio

[73] Assignee: Phillips Petroleum Company, Bartlesville, Okla.

[21] Appl. No.: 652,024

[22] Filed: Sep. 19, 1984

[51] Int. Cl.[4] ..... C10B 53/06; E21C 41/10

[52] U.S. Cl. ..... 299/2; 299/19

[58] Field of Search ..... 299/2, 18, 19; 166/259, 166/260; 405/267

[56] References Cited

U.S. PATENT DOCUMENTS

| | | | |
|---|---|---|---|
| Re. 31,677 | 9/1984 | Heald et al. | 299/2 |
| 3,349,848 | 10/1965 | Burgh | 166/259 |
| 3,489,672 | 1/1970 | Schulman | 208/11 R |
| 3,618,663 | 11/1971 | Needham | 166/254 |
| 4,007,963 | 2/1977 | Ridley | 299/2 |
| 4,149,595 | 4/1979 | Cha | 166/259 |
| 4,162,960 | 7/1979 | Dhondt | 208/11 R |
| 4,167,291 | 9/1979 | Ridley | 299/2 |
| 4,234,230 | 11/1980 | Weichman | 299/2 |
| 4,246,965 | 1/1981 | Cha | 166/251 |
| 4,266,612 | 5/1981 | French | 299/2 X |
| 4,285,547 | 8/1981 | Welchman | 299/2 |
| 4,349,227 | 9/1982 | Langford | 299/2 |
| 4,379,593 | 4/1983 | Welchman | 299/2 |

OTHER PUBLICATIONS

Baughman, "Synthetic Fuels Data Handbook", Second Edition, 1978, by Cameron Engineers, Inc.

*Primary Examiner*—George A. Suchfield

*Attorney, Agent, or Firm*—William R. Sharp

[57] ABSTRACT

A method for in situ processing of oil shale in which rubblized shale is removed from the retort and subsequently returned to the retort. A section of shale in a subterranean formation is first rubblized so as to form a retort chamber filled with rubble. The rubblized shale is then removed from the retort chamber, followed by crushing of the rubblized shale into shale particles of various sizes within an overall size range. Subsequent to the crushing step, the shale particles are separated according to size into a plurality of shale particle groups, each of which includes shale particles within a predetermined group size range. Each group size range makes up a portion of the overall size range. Substantially all of the shale particle groups are then sequentially reloaded into the retort chamber so that the particle groups are graded according to particle size within the chamber, wherein the largest particles are at bottom end of the chamber and the smallest particles are at the top end of the chamber. Retorting of the reloaded shale produces liquid hydrocarbon products which are removed from the retort chamber.

7 Claims, 4 Drawing Figures

METHOD FOR IN SITU SHALE OIL RECOVERY

BACKGROUND OF THE INVENTION

This invention relates to in situ processing of oil shale.

The presence of large deposits of oil shale in the Rocky Mountain regions of the United States have given rise to extensive efforts to develop methods of recovering shale oil from kerogen in the oil shale deposits. A number of methods have been proposed for processing the oil shale which involve either first mining the kerogen-bearing shale and processing the shale on the surface, or processing the shale in situ. The latter approach is preferable from the standpoint of environmental impact, since the treated shale remains in place, reducing the chance of surface contamination and the requirement for disposal of solid wastes.

A typical method (modified in situ recovery or MIS) of in situ shale oil recovery involves the mining of approximately 20–35 percent of the underground chamber or retort, and then explosively rubblizing the remaining shale in the retort to fill up the mined out area. The rubblized shale is then retorted by igniting a combustible gas and air (or $O_2$) at the top end of the retort so as to initiate a combustion front at the top of the retort. Once combustion has been initiated, only air (or $O_2$) is fed into the retort, combustion gas being generated by decomposition of kerogen. The combustion front passes down through the retort, retorting the shale therein so as to produce shale oil. Shale oil flows down the retort chamber by gravity, and is collected in a sump at the bottom of the retort for subsequent transport to the surface. The MIS process as described above is described in U.S. Pat. No. 4,167,291 of Ridley, whose disclosure is herein incorporated by reference. There are three major problems in prior in situ techniques which lead to inefficient recovery of shale oil.

The first problem associated with such a technique is the inability in prior methods of achieving a flat combustion front.

It has been found that the best yield of shale oil is obtained when the above mentioned combustion front is substantially flat, or perpendicular to its direction of advancement. If the front is skewed or warped, part of the front will reach the bottom of the retort ahead of the remainder of the front. The air will then have a tendency to flow out the retort through the area of the retort bottom where the front has broken through. Therefore, movement of the front will cease due to lack of supply of air, leaving a substantial portion of the rubblized shale unretorted.

The primary cause of a skewed or warped combustion front is non-uniform gas flow properties of the rubble bed due to spatial variation in void fractions. As used herein the term "void fraction" refers to the ratio of the volume of the voids or spaces between particles in the fragmented mass to the total volume of the fragmented permeable mass of particles in an in situ oil shale retort.

Inhomogeneities in void fractions stem from a tendency for oil shale fragments formed and displaced by the explosive blast to translate and rotate differently in one portion of the retort than in other portions. For example, fragments formed near the lateral boundaries of the retort tend to rotate more than fragments formed in the interior of the retort. The result of this is that the void fraction near the retort boundary is greater than in the retort interior. Permeability follows the same trend so that a combustion front which starts out being nominally flat at the top of the retort becomes umbrella-shaped as it moves downward and eventually breaks through the retort bottom first around the lateral boundaries. The result is that a significant portion of the retort (perhaps as much as 30 to 40%) may not be swept by the combustion front before breakthrough occurs and hence will not be retorted under optimal conditions. This particular difficulty in in situ oil shale retorting is generally regarded as the single most important cause for oil recovery efficiencies to be depressed below a level which would be theoretically possible.

The second major problem encountered in prior in situ techniques involves the undesirable burning of the larger shale particles. On a local scale (i.e., a region large enough to encompass one or two of the largest fragments and as many of the smaller fragments as may be in that region), the combustion front will move through the small fragments before the kerogen in the large fragments has been fully converted into shale oil. The result is that product from the large fragments is formed behind the combustion front and thus is apt not to be recovered, but rather burned.

The third major problem is the non-homogenity of the shale itself (i.e., layers or inclusions of clay and variations of kerogen content of the shale). When the combustion front reaches a layer of clay or shale having low kerogen content, lean shale, the front may slow or even cease.

SUMMARY OF THE INVENTION

It is, therefore, an object of the present invention to provide a method of in situ shale oil recovery which produces a higher yield of shale oil than in prior methods.

It is also an object of the present invention to provide an in situ method in which a substantially flat combustion front is created and maintained through the retorting process.

It is yet another object of the present invention to provide an in situ method which achieves a substantially uniform void fraction along any given cross section or horizontal zone of the shale rubble.

Finally, it is an object of the present invention to provide an in situ method wherein relatively few lean layers of rubble exist in the retort chamber.

The above objects are realized in a method of in situ processing of oil shale in which rubblized shale is removed from the retort and subsequently returned to the retort. A section of shale in a subterranean formation is first rubblized so as to form a retort chamber filled with rubble. The rubblized shale is then removed from the retort chamber, followed by crushing of the oversized rubblized shale into shale particles of various sizes within an overall size range. Subsequent to the crushing step, the shale particles are separated according to size into a plurality of shale particle groups, each of which includes shale particles within a predetermined group size range. Each group size range makes up a portion of the overall size range. Substantially all of the shale particle groups are then sequentially reloaded into the retort chamber. Retorting of the reloaded shale produces liquid hydrocarbon products which are removed from the chamber.

In one preferred embodiment of the present invention, the shale particle groups are reloaded into the retort chamber such that the shale particle groups are graded according to size within the chamber with the smallest particles at the top of the chamber and the largest particles at the bottom of the chamber. Additionally, some blending may be done before reloading.

Reloading the shale particles in the retort chamber as described above achieves a substantially uniform void fraction along any given cross section of the retort. Thus, gas flow is uniform through the shale particles such that a substantially flat combustion front is created and maintained. As noted above, such a flat front is desirable in order to retort most of the shale within the retort. In addition, any given local horizontal zone within the retort will have particles of substantially the same dimensions due to the separation of the shale particles into groups according to size. Thus, within any given local zone, substantially all of the kerogen in shale particles or fragments will be retorted. Finally, the separating and reloading steps have an overall blending or mixing effect which assists in avoiding lean intervals in the retort chamber.

DESCRIPTION OF THE PREFERRED EMBODIMENTS

A method of in situ recovery of shale oil is described herein wherein rubblized shale is removed and subsequently returned to a retort chamber.

Figure 1:
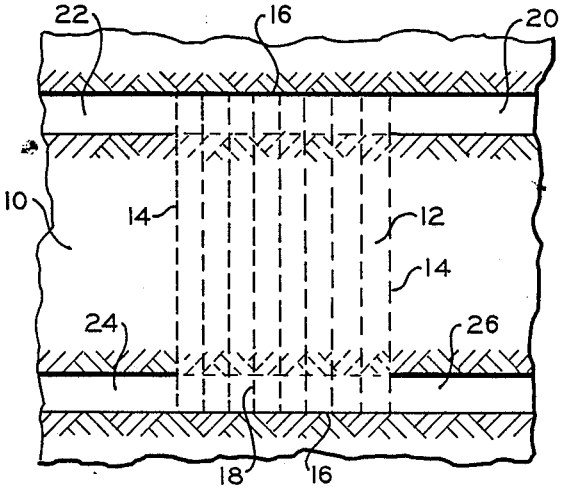
FIG. 1 is a schematic illustration of an oil shale section in a subterranean formation prepared for rubblizing.

Referring now to FIG. 1, there is shown a vertical cross section of a subterranean formation 10 having an oil shale section 12 therein prepared for rubblizing. As shown, shale section 12 has vertically extending boundaries 14 and horizontally extending boundaries 16. Although the shale section 12 is shown as having a preferred rectangular cross-section, it should be understood that the section may be any shape that allows an efficient layout for multiple retorting. It should also be understood that the section 12 is not necessarily shown to scale. In actual practice, the height of section 12 is preferably about three times the width. Also shown in FIG. 1 are blasting holes 18, which are generally uniformly spaced within shale section 12.

For a detailed discussion of blasting hole drilling in oil shale retorts, reference is made to U.S. Pat. No. 4,285,547 of Weichman, whose disclosure is herein incorporated by reference. Drifts 20, 22, 24, and 26 are also provided to permit access to shale section 12 so that workers may prepare shale section 12 for rubblizing. These drifts also assist in the removal and return of rubble as will be discussed below.

Before rubblizing of the shale in shale section 12, a certain fraction, typically 20–35 percent, of the shale in shale section 12 is preferably mined out or removed. This operation may take place at the top or bottom of shale section 12. If performed at the bottom, explosives or other means might be used to break up a bottom fraction of section 12 into large fragments. Typically, pillars of shale are left behind to support the remaining portion of shale section 12. The above large fragments may be removed through drifts 24 and 26 by trucks or any other suitable machinery. This mining out operation is performed primarily to form a void or expansion space which is later filled up by shale after rubblizing.

After the above described mining out operation, and after blasting holes 18 have been drilled, the blast holes are loaded, usually along their entire lengths, with suitable explosives. Rubblization of shale in section 12 is accomplished by detonating the explosives.

Figure 2:
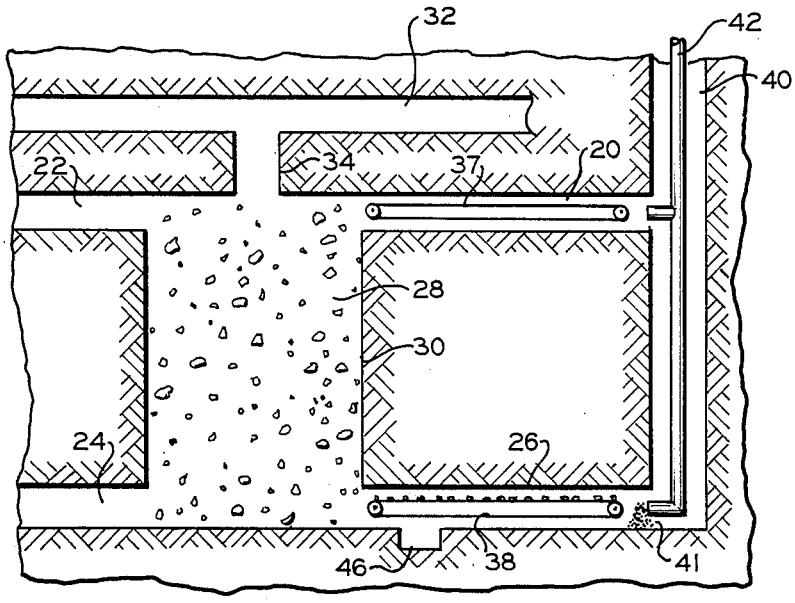
FIG. 2 is an illustration of a retort chamber filled with rubblized shale and associated means for removing and reloading shale into the retort chamber.

Referring now to FIG. 2, shale rubble 28 is shown resulting from the blasting described above. Rubblization produces shale fragments of many sizes randomly distributed throughout retort chamber 30. Retort chamber 30 is defined by subterranean walls formed along the above mentioned boundaries after rubblization.

Various other features, which will now be described in reference to FIG. 2, are now added at this point in the method. These additional features might be put in place before rubblization but are preferably added after rubblization to avoid damage from blasting.

An upper level drift 32 may be formed for connection to a conduit 34 which extends to retort chamber 30. Conduit 34 serves to conduct a flow of fuel gas and air, as will be explained below, into retort chamber 30. Conveyors 37 and 38 are provided within drifts 20 and 26 respectively. In addition, a vertical shaft 40 is provided which is connected to drifts 20 and 26 as shown. Shaft 40 extends to the surface to enable transport of shale to and from the surface by screw conveyor 42 mounted within shaft 40. Shaft 40 has other uses such as for transporting men and equipment, shale oil and air for personnel during construction, and for transmission of exhaust gases which will contain some shale oil as a mist to be recovered at the surface. A sump 46 is also provided to collect shale oil as will be explained below.

Rubblized shale 28 is transported by conveyor 38 along drift 26. Rubble from conveyor 38 forms a rubble pile 41, from which shale rubble is transported up screw conveyor 42 to the surface. This operation is continued until all rubble 28 is removed from retort chamber 30 and transported to the surface.

At this point in the method, a shale sizing operation is performed which will now be described. After the shale rubble has been transported to the surface, the oversized rubble is subjected to impact crushing, which produces shale particles of various sizes. These particle sizes are distributed over a size range which will hereinafter be referred to as an overall size range. The upper limit of such an overall size should preferably be about 1 foot. However, it should be understood that this upper limit depends on retorting conditions, etc. The crushed shale particles are than subjected to a screening operation using conventional screening apparatus (not shown), in which the shale particles are successively fed over screen mesh of various dimensions. For example, the shale particles might first be passed over a large mesh so as to separate out the larger material. The remaining particles may then be fed over one or more intermediate sized meshes, followed by screening by a fine mesh to yield a group of very fine particles. Thus, a plurality of shale particle groups are formed, wherein each group includes shale particles within a predetermined group size range. Therefore, each group size range makes up a portion of the overall size range. In the simplest case in which only three shale particle groups are formed, typical group size ranges are given as follows as an illustrative example: smaller than 0.1 inch or 10 mesh, or the fines; 0.1 inch to 1 inch, intermediate; and 1 inch to 10 inches, large. The sizes given are not any particular dimension of the particles, but indicate the size of mesh through which the particles will pass.

Although in the examples given above, only three particle groups are mentioned, it is preferable to separate the shale particles into as many groups as reasonably practical. The desirability of having many particle groups of many size ranges is due to the ultimate goal of obtaining uniform particle sizes across any given cross section of the retort chamber after reloading of the shale particles, as will become more apparent in the following discussion.

The separating step described above is preferably followed by blending of the shale particles in each group. Blending involves mixing of the particles to ensure that lean and rich particles are at least partially mixed. This guards against the possibility that a layer of very lean particles might be reloaded in the retort. Such a region of lean particles could conceivably stop progression of the combustion front in retorting. It should be understood that this blending may take place at any point before reloading of the shale in retort chamber 30. In some circumstances, it may prove desirable to "cross-blend" the particle groups before reloading them into retort chamber 30. For each particle group in such cross-blending, portions of one or more other particle groups may be blended therewith. For example, assuming one obtains three particle groups, four new particle groups could be produced employing cross-blending. These four new particle groups might include a coarsest group, a coarse/intermediate group, a fine/intermediate group, and a finest group. Such cross-blending optimizes the permeability and void fraction of the respective groups.

Figure 3:
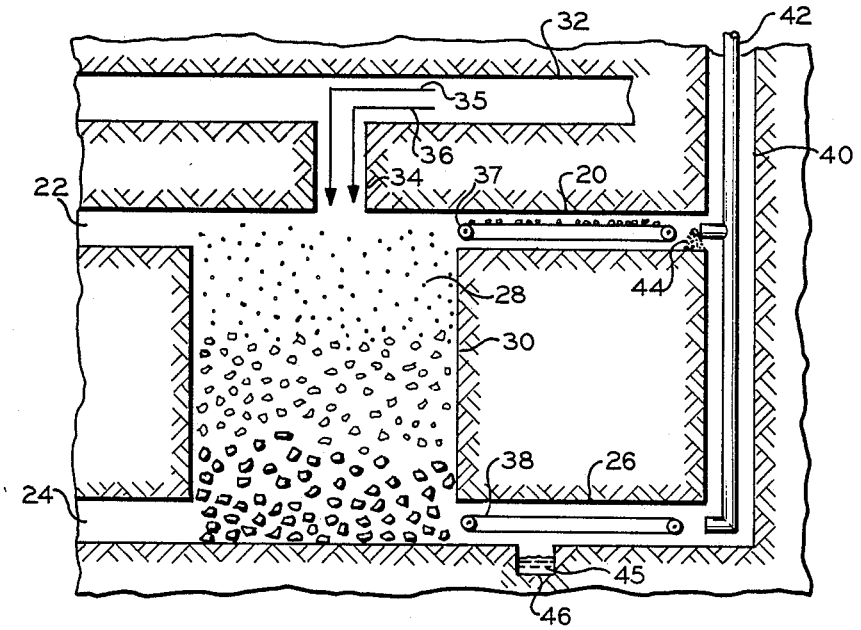
FIG. 3 shows the retort chamber reloaded with shale particles.

Referring now to FIG. 3, the same retort chamber configuration as depicted in FIG. 2 is shown, but at the reloading stage of the present method. Each shale particle group, described above, is sequentially reloaded into retort chamber 30 as follows. Shale particles in a particular group are transported from the surface by screw conveyor 42 to drift 20, and ejected to form a pile 44. Shale particles from pile 44 are then carried by conveyor 36 to retort chamber 30. Therefore, particles from a particular group fall from conveyor 36 and are dropped into chamber 30. Each other group is then sequentially reloaded into chamber 30 in a similar fashion. Typically, some distribution means (not shown) should be provided to evenly distribute particles falling from conveyor 36 throughout retort chamber 30. In addition, the finest particle group consisting of very fine particles (i.e. less than 10 mesh) is typically not reloaded for several reasons. First, very fine particles within the retort chamber tend to fall through void spaces and restrict fluid flow. Thus, by not reloading the finest group into the retort chamber, bed permeability is increased. Second, very fine particles result in undesirable levels of particulates in the oil product. Third, very fine particles tend to become entrained in the recycle gas so as to plug external piping and manifolding. Finally, it is desirable not to reload the finest particle group since fine particles tend to crush under the static pressures in the bed, causing further reductions in bed permeability and a resultant pressure drop. Therefore, it is preferable and most efficient to retort the fines above ground.

Preferably, as shown in FIG. 3, the shale particle groups are reloaded in retort chamber 30 such that the groups are graded according to particle size within the retort chamber.

The particular, and preferred, graded arrangement shown in FIG. 3 is characterized by the largest shale particles at the retort bottom and smallest particles at the retort top. An intermediate sized particle group is shown as being between the large and small group. It is emphasized, however, that although three particle groups of different size ranges are shown in FIG. 3, there may be any number (two or more) of particle groups within retort chamber 30 graded in a similar manner. As previously noted, as the number of particle groups reloaded into retort chamber is increased, expected shale oil yields will also increase. By reloading retort chamber 30 with the largest particles at the retort bottom as described above, this will encourage shale oil flow near the bottom of the retort chamber.

As an alternative to the embodiment shown in FIG. 3, the shale particle groups may be reloaded into retort chamber 30 with the smallest particles at the retort bottom. Certain advantages could result from this alternative arrangement. For example, creation of a shale particle bed in which particle sizes decrease in the downward direction would mean that the permeability would also decrease in the downward direction. This type of permeability gradient in the vertical direction would tend to minimize the importance of any permeability gradients which may exist in the horizontal direction. Specifically, if a portion of an initially planar combustion front starts to lead other portions because of high permeability in a certain zone in the particle bed, there would be a tendency for this leading portion to slow down as it encounters decreased permeability at greater depths. This would provide a mechanism for self-correction of departures from planarity in combustion fronts.

The shale particle groups can be reloaded into retort chamber 30 in any order which gives effective retorting. In this case or in either of the graded cases described above, the reloading operation achieves substantially uniform particle size across any given horizontal cross section of the retort. Thus, the above mentioned problem of the burning of large particles adjacent to smaller particles is reduced. In addition, a retort reloaded as described above can maintain a substantially flat combustion front due to uniform void fractions across a given cross section. Therefore, retorting does not leave a large amount of shale at the retort bottom unretorted as in prior in situ techniques.

It should also be noted that the crushing, separating, and reloading steps tend to mix the shale particles and produce a blending effect. Furthermore, when the shale particles are above ground, clay or very lean particles could be removed before reloading to further reduce the possibility of reloading a lean layer into retort chamber 30.

After the shale particles are reloaded into retort chamber 30, the shale is retorted. A combustible fuel gas, such as natural gas, and air, as indicated at 35 and 36, are passed through conduit 34 into retort chamber 30. The gas is ignited at the top of retort chamber 30, thereby initiating a combustion front. Once combustion is initiated, only air is fed into the retort chamber, such that the combustion front passes downward through retort chamber 30. Liquid hydrocarbon products are produced which flow down retort chamber 30 by gravity. The liquid hydrocarbon products 45 are collected in sump 46 which may be pumped to remove the products therein. Typically, drift 26 is sloped to facilitate flow of liquid products from retort chamber 30 to sump 46.

Figure 4:
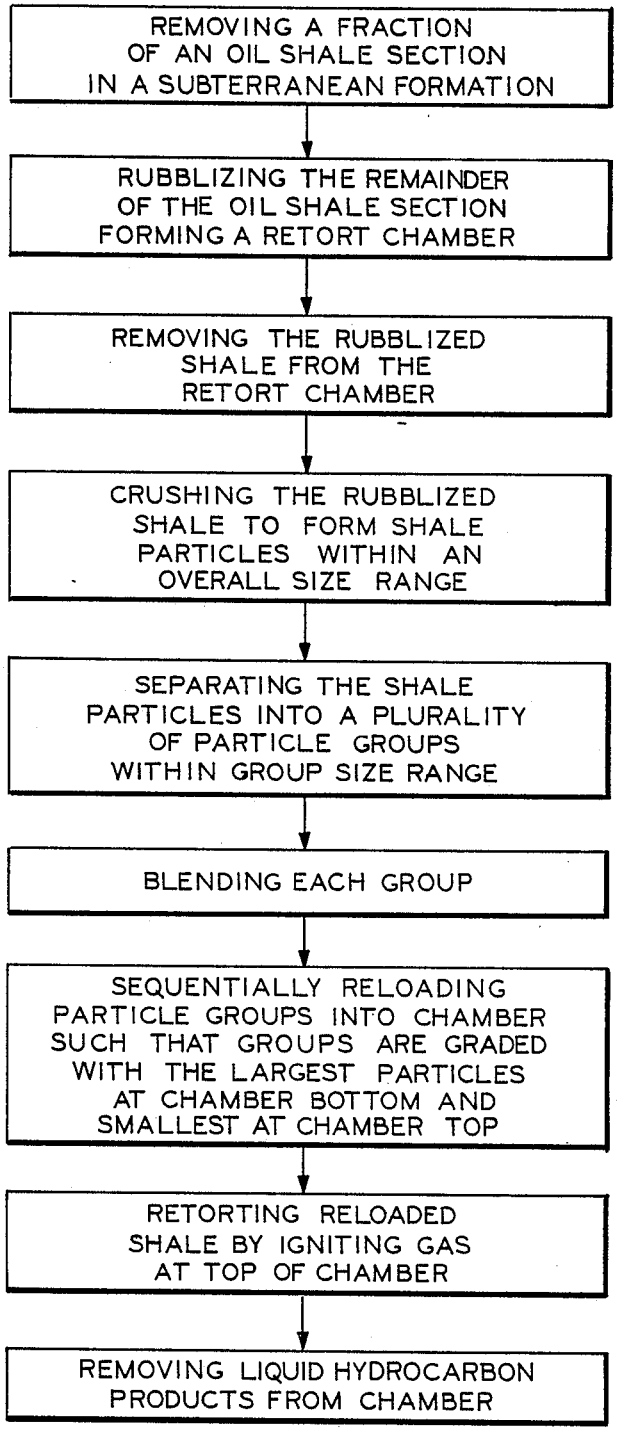
FIG. 4 is a flow chart showing the steps in a presently preferred embodiment of the present method.

Referring now to FIG. 4, there is shown a flow chart which outlines the steps of the preferred embodiment of the present method.

Thus, there is provided by the present invention a method of in situ recovery of shale oil which is highly efficient. Recoveries in excess of 90 percent of the Fishcher assay can be expected with the method of the present invention.

Obviously many modifications and variations of the present invention are possible in light of the above teachings. It is therefore to be understood that within the scope of the appended claims the invention may be practiced otherwise than as specifically described.

That which is claimed is:

1. A method of in situ processing of oil shale in a subterranean formation comprising the steps of:

rubblizing a section of oil shale in the subterranean formation, wherein the section has boundaries which form a retort chamber having a top end and a bottom end;

removing the rubblized shale from the retort chamber;

crushing the rubblized shale so as to produce shale particles of various sizes within a certain overall size range;

separating the shale particles according to size into a plurality of shale particle groups, wherein each group includes shale particles within a predetermined group size range, and wherein each group size range makes up a portion of the overall size range;

sequentially reloading substantially all of the shale particle groups into the retort chamber so that the shale particle groups are graded according to particle size within the chamber, wherein the largest shale particles are at the bottom end of the retort chamber and the smallest shale particles are at the top end of the retort chamber, the particles being evenly distributed throughout the retort chamber during reloading;

retorting the reloaded shale particles such that liquid hydrocarbon products are produced;

removing the liquid hydrocarbon products from the retort chamber.

2. A method as recited in claim 1, further comprising the step of blending the shale particles before said reloading step.

3. A method as recited in claim 2, wherein the retorting step includes the steps of passing a combustible gas through the reloaded shale particles within the retort chamber, and igniting the gas at the top end of the retort chamber.

4. A method as recited in claim 3, further comprising the step of removing a fraction of the oil shale section before the rubblizing step, wherein the remainder of the oil shale section is rubblized.

5. A method as recited in claim 4, wherein the fraction removed is about 20 to about 35 percent of the section.

6. A method as recited in claim 5, wherein the finest shale particle group is not reloaded into the retort chamber.

7. A method as recited in claim 6, wherein said particle groups are cross-blended.

* * * * *